US008076417B2

(12) United States Patent
Lai et al.

(10) Patent No.: US 8,076,417 B2
(45) Date of Patent: Dec. 13, 2011

(54) CROSSLINKED POLYETHYLENE ELASTIC FIBERS

(75) Inventors: Shih-Yaw Lai, Singapore (SG); Yuen-Yuen D Chiu, Pearland, TX (US); Ashish Sen, Lake Jackson, TX (US); Stephane Costeux, Richwood, TX (US)

(73) Assignee: Dow Global Technologies LLC, Midland, MI (US)

( * ) Notice: Subject to any disclaimer, the term of this patent is extended or adjusted under 35 U.S.C. 154(b) by 162 days.

(21) Appl. No.: 12/162,913

(22) PCT Filed: Feb. 7, 2007

(86) PCT No.: PCT/US2007/003297

§ 371 (c)(1),
(2), (4) Date: Jan. 8, 2009

(87) PCT Pub. No.: WO2007/097916

PCT Pub. Date: Aug. 30, 2007

(65) Prior Publication Data

US 2009/0306280 A1 Dec. 10, 2009

(51) Int. Cl.
*C08F 8/00* (2006.01)
*C08L 23/04* (2006.01)
*C08L 23/10* (2006.01)

(52) U.S. Cl. ..... 525/191; 525/240

(58) Field of Classification Search ..... 525/191, 525/240

See application file for complete search history.

(56) References Cited

U.S. PATENT DOCUMENTS

| | | | | |
|---|---|---|---|---|
| 4,076,698 | A | | 2/1978 | Anderson et al. |
| 4,425,393 | A | | 1/1984 | Benedyk et al. |
| 4,578,414 | A | | 3/1986 | Sawyer et al. |
| 4,644,045 | A | | 2/1987 | Fowells |
| 4,657,802 | A | | 4/1987 | Morman |
| 4,663,220 | A | | 5/1987 | Wisneski et al. |
| 4,803,117 | A | | 2/1989 | Daponte |
| 4,820,572 | A | | 4/1989 | Killian et al. |
| 4,830,907 | A | | 5/1989 | Sawyer et al. |
| 4,833,012 | A | | 5/1989 | Makimura et al. |
| 4,842,922 | A | | 6/1989 | Krupp et al. |
| 4,874,447 | A | | 10/1989 | Hazelton et al. |
| 4,909,975 | A | | 3/1990 | Sawyer et al. |
| 4,990,204 | A | | 2/1991 | Krupp et al. |
| 5,068,141 | A | | 11/1991 | Kubo et al. |
| 5,108,820 | A | | 4/1992 | Kaneko et al. |
| 5,112,686 | A | | 5/1992 | Krupp et al. |
| 5,336,552 | A | | 8/1994 | Strack et al. |
| 5,382,400 | A | | 1/1995 | Pike et al. |
| 5,824,717 | A | | 10/1998 | Merrill et al. |
| 6,005,053 | A | * | 12/1999 | Parikh et al. ..... 525/221 |
| 6,015,617 | A | | 1/2000 | Maugans et al. |
| 6,048,935 | A | | 4/2000 | Penfold et al. |
| 6,140,442 | A | | 10/2000 | Knight et al. |
| 6,194,532 | B1 | | 2/2001 | Maugans et al. |
| 6,225,243 | B1 | | 5/2001 | Austin |
| 6,342,565 | B1 | | 1/2002 | Cheng et al. |
| 6,437,014 | B1 | | 8/2002 | Ho et al. |
| 6,500,540 | B1 | | 12/2002 | Langohr et al. |
| 6,723,398 | B1 | | 4/2004 | Chum et al. |

FOREIGN PATENT DOCUMENTS

| | | | |
|---|---|---|---|
| JP | 09 291420 | | 11/1997 |
| JP | 2005/139212 | | 6/2005 |
| WO | WO-96/12762 | | 5/1996 |
| WO | WO-98/59000 | | 12/1998 |
| WO | WO-00/20668 | | 4/2000 |
| WO | WO-03/040442 | A1 | 5/2003 |
| WO | WO-03/078705 | | 9/2003 |
| WO | WO-2005/090425 | A1 | 9/2005 |
| WO | WO-2005/090426 | A1 | 9/2005 |
| WO | WO-2005/090427 | | 9/2005 |
| WO | WO-2005/111291 | | 11/2005 |

OTHER PUBLICATIONS

International Search Repot (PCT/US2007/003297).

* cited by examiner

*Primary Examiner* — Nathan M Nutter

(57) ABSTRACT

The present invention relates to crosslinked, olefin elastic fibers where the olefin materials are specifically selected to provide a more robust fiber with higher tenacity and greater temperature stability. Such fibers will be less subject to breakage during fiber spinning and post-spinning (downstream processing) operations including spool formation and unwinding. The specific olefin material used is a blend having an overall melt index (I2) of less than 2.5 g/10 min before crosslinking with a density in the range of 0.865 to 0.885 g/cm$^3$. One component of the blend will be characterized as having either a density in the range of from 0.855 to 0.88 g/cm$^3$ or a residual crystallinity at 80° C. of greater than 9 percent but not both. The at least one other component will meet at least whichever characteristic the first component does not meet.

21 Claims, No Drawings

CROSSLINKED POLYETHYLENE ELASTIC FIBERS

FIELD OF THE INVENTION

The present invention relates to crosslinked, olefin elastic fibers where the olefin materials is specifically selected to provide a more robust fiber with higher tenacity and greater temperature stability. Such fibers will be less subject to breakage during fiber spinning and post-spinning (downstream processing) operations including spool formation and unwinding.

BACKGROUND AND SUMMARY OF THE INVENTION

A variety of fibers and fabrics have been made from thermoplastics, such as polypropylene, highly branched low density polyethylene (LDPE) made typically in a high pressure polymerization process, linear heterogeneously branched polyethylene (for example, linear low density polyethylene made using Ziegler catalysis), linear and substantially linear homogeneously branched polyethylene, blends of polypropylene and linear heterogeneously branched polyethylene, blends of linear heterogeneously branched polyethylene, and ethylene/vinyl alcohol copolymers.

Fiber is typically classified according to its denier (gms/9000 m). Monofilament fiber is generally defined as having an individual fiber denier greater than about 14. Fine denier fiber generally refers to a fiber having a denier less than about 10 denier per filament. Microdenier fiber is generally defined as fiber less than 1 denier or less than 10 microns.

The fiber can also be classified by the process by which it is made, such as monofilament, continuous wound fine filament, staple or short cut fiber, spun bond, and melt blown fiber.

Many polyolefin materials are known to be useful in the formation of fiber. Linear heterogeneously branched polyethylene has been made into monofilament, as described in U.S. Pat. No. 4,076,698 (Anderson et al.). Linear heterogeneously branched polyethylene has also been successfully made into fine denier fiber, as disclosed in U.S. Pat. No. 4,644,045 (Fowells), U.S. Pat. No. 4,830,907 (Sawyer et al.), U.S. Pat. No. 4,909,975 (Sawyer et al.) and in U.S. Pat. No. 4,578,414 (Sawyer et al.). Blends of such heterogeneously branched polyethylene have also been successfully made into fine denier fiber and fabrics, as disclosed in U.S. Pat. No. 4,842,922 (Krupp et al.), U.S. Pat. No. 4,990,204 (Krupp et al.) and U.S. Pat. No. 5,112,686 (Krupp et al.). U.S. Pat. No. 5,068,141 (Kubo et al.) also discloses making nonwoven fabrics from continuous heat bonded filaments of certain heterogeneously branched LLDPE having specified heats of fusion.

However, fibers made from all of these types of saturated olefinic polymers are not naturally "elastic" (as that term is defined below) thus limiting their use in elastic applications. One attempt to alleviate this problem by incorporating additives into the polymer prior to melt spinning is disclosed in U.S. Pat. No. 4,663,220 (Wisneski et al.). Wisneski et al. disclose fibrous elastomeric webs comprising at least about 10 percent of a styrenic block copolymer and a polyolefin. The resultant webs are said to have elastomeric properties.

U.S. Pat. No. 4,425,393 (Benedyk) discloses monofilament fiber made from polymeric material having an elastic modulus from 2,000 to 10,000 psi. The polymeric material includes plasticized polyvinyl chloride (PVC), low density polyethylene (LDPE), thermoplastic rubber, ethylene-ethyl acrylate, ethylene-butylene copolymer, polybutylene and copolymers thereof, ethylene-propylene copolymers, chlorinated polypropylene, chlorinated polybutylene or mixtures of those.

Elastic fiber and web prepared from a blend of at least one elastomer (that is, copolymers of an isoolefin and a conjugated polyolefin (for example, copolymers of isobutylene and isoprene)) and at least one thermoplastic is disclosed in U.S. Pat. No. 4,874,447 (Hazelton et al.).

U.S. Pat. No. 4,657,802 (Morman), discloses composite nonwoven elastic webs and a process for their manufacture. The elastic materials useful for forming the fibrous nonwoven elastic web include polyester elastomeric materials, polyurethane elastomeric materials, and polyamide elastomeric materials.

U.S. Pat. No. 4,833,012 (Makimura et al.), discloses nonwoven entanglement fabrics made from a three dimensional entanglement of elastic fibers, nonshrinkable nonelastic fibers, and shrinkable elastic fibers. The elastic fibers are made from polymer diols, polyurethanes, polyester elastomers, polyamide elastomers and synthetic rubbers.

Composite elastomeric polyether block amide nonwoven webs are disclosed in U.S. Pat. No. 4,820,572 (Killian et al.). The webs are made using a melt blown process and the elastic fibers are made from a polyether block amide copolymer.

Another elastomeric fibrous web is disclosed in U.S. Pat. No. 4,803,117 (Daponte). Daponte discloses that the webs are made from elastomeric fibers or microfibers made from copolymers of ethylene and at least one vinyl monomer selected from the group including vinyl ester monomers, unsaturated aliphatic monocarboxylic acids and alkyl esters of these monocarboxylic acids. The amount of the vinyl monomer is said to be "sufficient" to impart elasticity to the melt-blown fibers. Blends of the ethylene/vinyl copolymers with other polymers (for example, polypropylene or linear low density polyethylene) are also said to form the fibrous webs.

While previous efforts to make elastic fibers and fabrics from olefinic polymers have focused on polymer additives, these solutions have potential detriments, including the increased cost of the additives, and substandard spinning performance.

More recently, elastic fibers made from polyolefin materials and particularly crosslinked polyolefin materials, such as those disclosed in U.S. Pat. Nos. 5,824,717; 6;048,935; 6,140,442; 6,194,532; 6,437,014, 6,500,540, and 6,500,540 have received much attention, particularly in the field of textiles and apparel. The crosslinked, olefin elastic fibers include ethylene polymers, propylene polymers and fully hydrogenated styrene block copolymers (also known as catalytically modified polymers). The ethylene polymers are preferred for many applications and include the homogeneously branched and the substantially linear homogeneously branched ethylene polymers as well as ethylene-styrene interpolymers. These crosslinked, olefin elastic fibers have been lauded for their chemical and heat resistance, their durability and their comfort stretch, and they are accordingly growing in popularity in both weaving and knitting applications.

The superior properties of these crosslinked olefin elastic fibers have led to their commercial success. However, it has been reported that such fibers still experience a rate of breaking which is higher than desired during downstream processing of fibers. Fiber breaks occur during bobbin formation, spool unwinding and winding, drafting (during yarn making or covering), cone dyeing, and at friction points during knitting operations. While the rate of fiber breakage is commercially acceptable, it could still be improved. Accordingly, it is a goal of the present invention to provide a more robust crosslinked polyolefin elastomeric fiber, to further reduce the rate of occurrence of downstream fiber breaks. This goal must be balanced against other interests, however. In particular the goal must not come at the expense of acceptable fiber processing characteristics. Properties such as good spinnability, good elongation to break, retractive force, crosslinkability, tackiness and temperature resistance, must remain acceptable.

It has been discovered that using a composition comprising a polyolefin blend having a melt index ($I_2$) less than 2.5 g/10 min with a density in the range of 0.86 to 0.89 g/cm$^3$ improves the tenacity of the fiber while avoiding tackiness and preserving the elastic behavior. The compositions for use in the present inventions comprise at least two components. The components can be classified according to the following characteristics. Characteristic (a) is that the polyolefin material has a density in the range of 0.855 to 0.880 g/cm$^3$. Characteristic (b) is that the polyolefin material has a residual crystallinity at 80° C. greater than or equal to 9 percent. It is believed that materials meeting characteristic (a) impart elasticity and crosslinkability to the fiber whereas material meeting characteristic (b) impart heat stability to the fiber. For the fibers of the present invention, blends of two or more polyolefin components are used where at least one of the components meets either (a) or (b) but not both. The second component is selected such that it will meet whichever characteristic ((a) or (b)) the first component does not meet. It is within the scope of the invention that the second component can meet only one of these characteristics or both simultaneously.

The fibers made from such materials exhibit improved retractive power, which leads to better properties of the fiber at ambient temperature and better dimensional stability at higher temperatures.

Despite the belief among those skilled in the art that higher molecular weight materials results in higher spinline stress and therefore more breaks, it has surprisingly been observed that the compositions of the present invention exhibit excellent spinnability, both in terms of the processability in an extruder and in terms of the drawability of the melt after exiting the extruder.

DETAILED DESCRIPTION OF THE INVENTION

For purposes of this invention the following terms shall have the given meanings:

"Polymer" means a macromolecular compound prepared by polymerizing monomers of the same or different type. "Polymer" includes homopolymers, copolymers, terpolymers, interpolymers, and so on. The term "interpolymer" means a polymer prepared by the polymerization of at least two types of monomers or comonomers. It includes, but is not limited to, copolymers (which usually refers to polymers prepared from two different types of monomers or comonomers, although it is often used interchangeably with "interpolymer" to refer to polymers made from three or more different types of monomers or comonomers), terpolymers (which usually refers to polymers prepared from three different types of monomers or comonomers), tetrapolymers (which usually refers to polymers prepared from four different types of monomers or comonomers), and the like. The terms "monomer" or "comonomer" are used interchangeably, and they refer to any compound with a polymerizable moiety which is added to a reactor in order to produce a polymer. In those instances in which a polymer is described as comprising one or more monomers, for example, a polymer comprising propylene and ethylene, the polymer, of course, comprises units derived from the monomers, for example, —$CH_2$—$CH_2$—, and not the monomer itself, for example, $CH_2$=$CH_2$.

"Fiber" means a material in which the length to diameter ratio is greater than about 10. Fiber is typically classified according to its diameter. Filament fiber is generally defined as having an individual fiber diameter greater than about 15 denier; usually greater than about 30 denier. Fine denier fiber generally refers to a fiber having a diameter less than about 15 denier. Microdenier fiber is generally defined as fiber having a diameter less than about 10 microns denier.

"Filament fiber" or "monofilament fiber" means a single, continuous strand of material of indefinite (that is, not predetermined) length, as opposed to a "staple fiber" which is a discontinuous strand of material of definite length (that is, a strand which has been cut or otherwise divided into segments of a predetermined length).

"Homofilament fiber" means a fiber that has a single polymer region or domain over its length, and that does not have any other distinct polymer regions (as does a bicomponent fiber). "Bicomponent fiber" means a fiber that has two or more distinct polymer regions or domains over its length. Bicomponent fibers are also known as conjugated or multicomponent fibers. The polymers are usually different from each other although two or more components may comprise the same polymer. The polymers are arranged in substantially distinct zones across the cross-section of the bicomponent fiber, and usually extend continuously along the length of the bicomponent fiber. The configuration of a bicomponent fiber can be, for example, a cover/core (or sheath/core) arrangement (in which one polymer is surrounded by another), a side by side arrangement, a pie arrangement or an "islands-in-the sea" arrangement. Bicomponent or conjugated fibers are further described in U.S. Pat. Nos. 6,225,243, 6,140,442, 5,382,400, 5,336,552 and 5,108,820.

"Elastic" means that a fiber will recover at least about 50 percent, more preferably at least about 60 percent even more preferably 70 percent of its stretched length after the first pull and after the fourth pull to 100 percent strain (double the length). One suitable way to do this test is based on the one found in the International Bureau for Standardization of Man-made Fibers, BISFA 1998, chapter 7, option A. Under such a test, the fiber is placed between grips set 4 inches apart, the grips are then pulled apart at a rate of about 20 inches per minute to a distance of eight inches and then allowed to immediately recover. "Immediate set" can also be used to characterize recovery. In the above test, the grips are returned to the initial starting point (that is, 4 inches apart) and pulled apart at the same rate (20 inches per minute in the above test), and the immediate set is defined to be the difference between the length of the fiber at the point at which the fiber begins to pull a load and the original length divided by the original length. For purposes of this invention "elastic" means that the fiber has an immediate set of less than 50 percent, more preferably less than 40 percent and even more preferably less than 30 percent after pulling to 100 percent strain.

For the purposes of this application, "polyolefin blend" means a composition having two or more polyolefin components. "Blends" as used herein includes compositions formed from physically mixing two or more components as well as so-called in-reactor blends where two or more components exist contemporaneously in one or more reactors.

In a first aspect, the present invention relates to a crosslinked elastic fiber characterized in that the fiber has been made from a composition comprising a polyolefin blend having an overall melt index ($I_2$) less than or equal to 2.5 g/10 min with an overall density in the range of 0.865 to 0.885 g/cm$^3$. Density is determined according to ASTM D-792.

Preferably the density for the overall composition is in the range of 0.868 to 0.880 g/cm$^3$, most preferably in the range of 0.870 to 0.878 g/cm$^3$. Melt index as determined according to ASTM D-1238, Condition 190° C./2.16 kg (formally known as "Condition (E)" and also known as $I_2$). Preferably the overall $I_2$ will be in the range of from 0.1 to 2.5 g/10 min. More preferably the $I_2$ will be less than or equal to about 2.0 g/10 min and even more preferably less than or equal to about 1.5 g/10 min.

The polyolefin blend for use in the present inventions will comprise at least two polyolefin components. The components can be classified according to the following characteristics. Characteristic (a) is that the polyolefin material has a density in the range of 0.855 to 0.880 g/cm$^3$. Characteristic (b) is that the polyolefin material has a Residual Crystallinity at 80° C. greater than or equal to 9 percent. "Residual Crystallinity" is determined using Differential Scanning Calorimety as described below. For the fibers of the present invention, blends of two or more polyolefin components are used where at least one of the components meets either (a) or (b) but not both. The second component is selected such that it will meet whichever characteristic ((a) or (b)) the first component does not meet. It is within the scope of the invention that the second component can meet only one of these characteristics or both simultaneously.

The olefin polymer for use in each component of the polyolefin blends of the present invention can be any olefin based material capable of use in forming a fiber. For purposes of the present invention an olefin is an unsaturated aliphatic hydrocarbon having from 2-20 carbon atoms, and "olefin based" means that at least 50 percent by weight of the polymer is derived from an olefin. Olefin based polymers for use in the present invention includes ethylene-alpha olefin interpolymers, propylene alpha olefin interpolymers (including propylene ethylene copolymers, and particularly propylene-ethylene plastomers and elastomers such as those described in WO03/040442), ethylene styrene interpolymers, polypropylenes, segmented block copolymers (see for example WO 2005/090427, WO 2005/090425 and WO 2005/090426) and combinations thereof. Segmented block copolymers are known which meet both characteristic (a) and characteristic (b). Hence these polymers may form a blend with either a material which meets characteristic (a) but not (b) or a material which meets characteristic (b) but not (a). For example, olefinic segmented block copolymers can be advantageously used with a homogeneously branched ethylene polymer meeting characteristic (a), or a polypropylene based material meeting characteristic (b). Segmented block copolymers can also be designed such that they do not meet either characteristic (a) or (b) in which case both components may comprise segmented block copolymers.

It is generally preferred that at least one component be a crosslinked polyethylene fiber, of which crosslinked homogeneously branched ethylene polymers are particularly preferred. Butene, hexene and octene are preferred comonomers. The broad class of homogeneously branched ethylene polymers is broadly described in U.S. Pat. No. 6,437,014, (which is hereby incorporated by reference in its entirety).

It should be understood that by altering the molecular architecture of polyolefin based materials, it is possible to have the same type of polyolefin meet either characteristic (a) or (b). For example in a preferred embodiment of the present invention a homogeneously branched ethylene polymer constitutes each component, with one homogeneously branched ethylene polymer having a density such that it meets characteristic (a), and a second homogeneously branched ethylene polymer having a higher density, which meets characteristic (b). In such an embodiment it is preferred that the second homogeneously branched ethylene polymer have a density greater than 0.890 g/cm$^3$, more preferably greater than 0.910 g/cm$^3$.

Preferably, characteristic (a) is that the polyolefin material has a density in the range of 0.855 to 0.875 g/cm$^3$, even more preferably from 0.858 to 0.870 g/cm$^3$, even more preferably in the range from 0.860 to 0.865 g/cm$^3$.

Preferably, characteristic (b) is that the polyolefin material has Residual Crystallinity at 80° C. greater than or equal to 10 percent more preferably greater than or equal to 14 percent and even more preferably greater than or equal to 18 percent It is preferred that the material meeting characteristic (a) have a melt index ($I_2$) less than or equal to 2 g/10 min, more preferably less than or equal to 1.5 g/10 min, and even more preferably less than or equal to 1.3 g/10 min. This is particularly true of materials which meet characteristic (a) but not characteristic (b).

The embodiments in which ethylene blends are used to make the fiber of the present invention will also preferably have an overall Residual Crystallinity at 80° C. greater than or equal to 4 percent, more preferably greater than or equal to 5 percent, still more preferably greater than or equal to 7 percent.

Residual crystallinity for the present invention is determined using Differential Scanning Calorimetry (DSC), a common technique that can be used to examine the melting and crystallization of semi-crystalline polymers. General principles of DSC measurements and applications of DSC to studying semi-crystalline polymers are described in standard texts (for example, E. A. Turi, ed., *Thermal Characterization of Polymeric Materials*, Academic Press, 1981). Certain of the copolymers used in the practice of this invention are characterized by a DSC curve with a $T_{me}$ that remains essentially the same and a $T_{max}$ that decreases as the amount of unsaturated comonomer in the copolymer is increased. $T_{me}$ means the temperature at which the melting ends. $T_{max}$ means the peak melting temperature.

Differential Scanning Calorimetry (DSC) analysis is determined using a model Q1000 DSC from TA Instruments, Inc. Calibration of the DSC is done as follows. First, a baseline is obtained by running the DSC from −90° C. to 290° C. without any sample in the aluminum DSC pan. Then 7 milligrams of a fresh indium sample is analyzed by heating the sample to 180° C., cooling the sample to 140° C. at a cooling rate of 110° C./min followed by keeping the sample isothermally at 140° C. for 1 minute, followed by heating the sample from 140° C. to 180° C. at a heating rate of 110° C./min. The heat of fusion and the onset of melting of the indium sample are determined and checked to be within 0.5° C. from 156.6° C. for the onset of melting and within 0.5 J/g from 28.71 J/g for the heat of fusion. Then deionized water is analyzed by cooling a small drop of fresh sample in the DSC pan from 25° C. to −30° C. at a cooling rate of 10° C./min. The sample is kept isothermally at −30° C. for 2 minutes and heated to 30° C. at a heating rate of 10° C./min. The onset of melting is determined and checked to be within 0.5° C. from 0° C.

The sample is pressed into a thin film and melted in the press at about 175° C. and then air-cooled to room temperature (25° C.). 3-10 mg of material is then cut into a 6 mm diameter disk, accurately weighed, placed in a light aluminum pan (ca 50 mg). The lid is crimped on the pan to ensure a closed atmosphere. The sample pan is placed in the DSC cell. A nitrogen purge gas flow of 50 ml/min is used. The cell is heated at a high rate of 100° C./min to a temperature of 60° C. above the melt temperature. The sample is kept at this temperature for about 3 minutes. Then the sample is cooled at a rate of 10° C./min to −40° C., and kept isothermally at that temperature for 3 minutes. Consequently the sample is heated at a rate of 10° C./min until complete melting. The resulting enthalpy curves are analyzed for peak melt temperature, onset and peak crystallization temperatures, heat of fusion and heat of crystallization, $T_{me}$, and any other DSC analyses of interest. The Residual Crystallinity at each temperature can be calculated by determining the baseline drawn between −30° C. and end of melting, and integrating the exotherm to obtain the cumulative heat of fusion between 80° C. and the end of melting. This operation can be performed routinely using the TA Advantage software. The heat of fusion is then divided by the heat of fusion of a perfect crystal. For instance, for polyethylene based polymers, the heat of fusion for a perfect crystal is 292 μg (corresponding to 100 percent crystallinity) and for polypropylene based polymers the heat of fusion for a perfect crystal is 165 J/g. As an example, if the cumulative heat of fusion of a polyethylene based polymer between 80° C. and the end of melting is 15.5 J/g, the residual crystallinity at this temperature is 15.5/292=5.3 percent.

The molecular weight distribution (MWD), or polydispersity index (PDI) of the overall polyolefin blend used to make the fibers of this invention is preferably less than about 3 and more preferably less than about 2.5. "MWD", "PDI" and similar terms mean a ratio ($M_w/M_n$) of weight average molecular weight ($M_w$) to number average molecular weight ($M_n$). PDI can be determined by methods generally known in the art, for example via Gel Permeation Chromatography (GPC) as described in WO2005/111291.

In a preferred embodiment, the first polyolefin component and the second polyolefin component preferably each have a PDI less than 3.0, more preferably less than about 2.5.

The composition used to make the fiber of the present invention may advantageously comprise one or more other materials, including fillers (such as of talc, synthetic silica; precipitated calcium carbonate, zinc oxide, barium sulfate and titanium dioxide and mixtures thereof), processing aids (such as polydimethylsiloxane (PDMSO)), slip agents, antiblocking agents, pigments (such as $TiO_2$), compatibilizers, co-agents for improving crosslinkability such as dienes. The addition of filler is especially preferred at levels of from 0.1 to about 2 percent by weight of the composition.

The blend for use in the invention can be formed in situ in one or more reactors or be dry blending as is generally known in the art. Regardless of how the blend is formed, preferably, the polyolefin component meeting characteristic (a) will comprise at least about 50 percent by weight of the composition, preferably at least 55 percent, more preferably at least about 60 percent by weight of the composition and up to about 95 percent by weight of the composition, preferably up to about 80 percent and more preferably up to about 70 percent by weight of the composition. The polyolefin component meeting characteristic (b) will preferably comprise at least about 5 weight percent of the composition, more preferably at least about 20 percent, and even more preferably at least about 30 percent of the overall composition and up to about 50 percent by weight of the composition, preferably up to about 45 percent and more preferably up to about 40 percent by weight of the composition. The above indications of weight percentages are particularly valid where a single component does not meet both component (a) and component (b), as in these cases a single component will be counted towards the weight percentage of each characteristic. For example, when a segmented block polymer is used which meets both characteristic (a) and (b), then the polyolefin component meeting characteristic (b) may comprise up to about 80 percent by weight of the composition.

Fiber of the present invention can be monofilament or bicomponent fibers, with monofilament fibers being generally most preferred. "Bicomponent fiber" means a fiber that has two or more distinct polymer regions or domains whereas monofilament fibers are substantially uniform. Bicomponent fibers are also known as conjugated or multicomponent fibers. The polymer compositions which comprise each region are usually different from each other although two or more regions may comprise the same polymer composition. The polymers are arranged in substantially distinct zones across the cross-section of the bicomponent fiber, and usually extend continuously along the length of the bicomponent fiber. The configuration of a bicomponent fiber can be, for example, a sheath/core arrangement (in which one polymer is surrounded by another), a side by side arrangement, a pie arrangement or an "islands-in-the sea" arrangement.

The sheath core arrangement is a preferred embodiment of bicomponent fibers. In such an embodiment, it is preferred that the above-described blends comprise at least the sheath, whereas the core may also comprise the above-described blends or alternatively another material. The core is preferably an elastic material which includes elastic polyolefins as well as other materials such as thermoplastic polyurethanes (TPUs). In another embodiment of the bicomponent fibers of the present invention the core comprises a polyolefin component meeting characteristic (a) and the sheath comprises a polyolefin component meeting characteristic (b). Bicomponent fibers are further described in U.S. Pat. Nos. 6,225,243, 6,140,442, 5,382,400, 5,336,552 and 5,108,820.

The fiber of the present invention can be formed form the above-described compositions by any method known in the art, with melt spinning being preferred. Melt spinning can be done at speeds up to the maximum speed achievable with the given equipment (e.g speeds greater than 500 m/min, 1000 m/min, and even 2000 m/min are potentially achievable). Similarly, the fibers can be crosslinked by any method known in the art. Suitable crosslinking methods are disclosed in U.S. Pat. No. 6,437,014, herein incorporated by reference in its entirety, as are all references cited in this disclosure. The fibers of the present invention can be of any thickness but in general fibers of 10 to 400 denier are most preferred.

The fibers of the present invention may be used neat (or bare) or may be combined into a yarn with an inelastic fiber such as cotton, wool, or synthetic material such as polyester or nylon.

The fibers, whether neat or used with other material in a yarn, may be used alone or together with other yarns to make textiles according to known fabrication methods such as weaving or knitting. The fibers of the present invention are particularly well suited for knitting applications.

EXAMPLES

In order to demonstrate the efficacy of the present invention, a series of fibers were made using the following materials:

Composition A comprises 65 percent by weight of an ethylene-butylene copolymer having a density of 0.862 g/cm$^3$ (measured according to ASTM D 792, Method B), a melt index ($I_2$) of 1.2 g/10 min (measured according to ASTM 1238 at 190° C. with a 2.16 kg weight) and a polydispersity index (PDI) of 2.0 as determined according using GPC, and 35 percent by weight of an ethylene-octene copolymer having a density of 0.902 g/cm$^3$, a melt index ($I_2$) of 1.0 g/10 min, a PDI of 2.2, and a Residual Crystallinity at 80° C. of 20.7 percent. The ethylene-butylene copolymer meets characteristic (a) and not characteristic (b) and the ethylene-octene copolymer meets characteristic (b) but not (a). The residual crystallinity above 80° C. for Composition A is 7.6 percent as measured according to the DSC method described above. The overall density of Composition A is 0.875 g/cm$^3$.

Composition B is 100 percent of a CGC catalyzed ethylene-octene copolymer having a density of 0.875 g/cm$^3$ and a melt index ($I_2$) of 3 g/10 min. The Residual Crystallinity above 80° C. for Composition B is 0.40 percent.

Composition C is 100 percent CGC catalyzed ethylene-octene copolymer having a density of 0.870 g/cm$^3$ and a melt index ($I_2$) of 1 g/10 min. The Residual Crystallinity above 80° C. for Composition C is 0.05 percent.

1.3 percent by weight of an additive package comprising Cyanox 1790, Chimassorb 944 and PDMSO is added to each of these Compositions in an extruder to ensure thorough mixing.

The compounded materials are then used to spin 40, 70 and 140 denier fibers on a Foume melt spinning line, between 280° C. and 290° C., with a 0.8 mm monofilament round die. Winding is carried out between 400 and 600 m/min as indicated in Table I.

These fibers are evaluated to determine the load at break, the elongation at break and the load at 300 percent elongation. An Instron Universal Tester equipped with pneumatic grips with a 4 inch jaw span is used to obtain these measurements using the following procedure. Spools of elastic fiber to be tested are first allowed to equilibrate to the testing laboratories atmosphere, which is ideally around 23° C. with a relative humidity of about 50 percent. An approximately 6 inch long test specimen is then obtained from the spool. A pretension weight set at 1 mg/denier (for example, a 40 mg pretension weight is attached to a 40 denier fiber) is attached to one end of the fiber specimen. Using tweezers, the free end of the specimen is inserted into the center of the upper grip of the Instron tester, and the upper grip is then closed. The pretension weight is allowed to hang freely (if necessary, tweezers are used to guide the fiber to the center of the lower grip) and the lower grip is then closed. With a computer or strip chart recorder recording the elongation and force, the crosshead is pulled apart at a rate of 20 inches per minute (about 508 mm/min) until the fiber breaks. The percent elongation at break is defined as the change in sample length at the point when the fiber breaks divided by the original jaw span times 100. The load at break is the force in grams measured at the point where the fiber breaks. The load at 300 percent is the force required to stretch the fiber to a length which is 4 times its original length.

Results for the Compositions listed above are as indicated in Table I below.

TABLE I

Mechanical properties for uncrosslinked 40D fibers
Fibers spun on Fourne Line at 300° C.

| | spinning speed m/min | Load (g) @break | Elongation @break (percent) | Load (g) @300 percent |
|---|---|---|---|---|
| Composition A | 400 | 41.2 | 577 | 10.2 |
| | 500 | 47.8 | 518 | 14.7 |
| | 600 | 51.4 | 501 | 16.1 |
| Composition B (comparative) | 400 | 38.2 | 619 | 4.5 |
| | 500 | 41.2 | 556 | 5.6 |
| | 600 | 44.5 | 448 | 9.8 |
| Composition C (comparative) | 400 | 48.2 | 472 | 7.1 |
| | 500 | 56.2 | 422 | 11.8 |
| | 600 | 57.7 | 378 | 19.5 |

The fibers are then crosslinked by e-beaming such that the fibers have a gel content greater than 60 percent by weight as determined using xylene extractables in accordance with ASTM D-2765

Dynamic Mechanical Thermal Analysis (DMTA) is performed on a Rheometrics RSAIII on a bundle of 30 to 60 forty denier fibers free of any twist or tension. The temperature is set to 25° C. and initial force of 5 g is applied. The temperature is increased at 5° C./min while monitoring the elastic modulus E' at a constant frequency of 10 rad/s. A minimum tensile force of 2 g is maintained during the test to avoid any slack as the temperature increases. Results from this measurement are as presented in Table II.

TABLE II

DMTA modulus measured at 10 rad/s on crosslinked 40 den fibers (19.2 MRad)

| | DMTA modulus E' (MPa) | |
|---|---|---|
| | At 80° C. | At 120° C. |
| Composition A | 5.02 | 1.51 |
| Composition B (comparative) | 1.11 | 0.92 |

Retractive Force was also measured on the 40 denier fibers. Using the Instron tester described above, the fiber is immersed in a 80° C. water bath and then stretched at a rate of 20 in/min to an elongation of 250 percent (that is, in this test, the 4 inch fiber is stretched 10 inches to a total sample length of 14 inches). The fiber is held at this elongation for 10 minutes and then the crosshead is returned its original position at the same rate as the extension, thus allowing the fiber to shrink. The load on the fiber is then measured during the shrinkage at 10 and 20 percent shrinkage. The percent shrinkage is defined from the maximum length of the fiber at 250 percent elongation (that is, 3.5 times the initial gauge). For example, 10 percent shrinkage is measured at 90 percent of maximum elongation (14 inches) or a gauge length of 12.6 inches in this test. Similarly 20 percent shrinkage is measured at a gauge length of 11.2 inches. Results from this determination are as shown in Table III.

TABLE III

| | Retractive force at 80° C. | |
|---|---|---|
| | At 10 percent shrinkage | At 20 percent shrinkage |
| Composition A | 0.98 | 0.71 |
| Composition B (comparative) | 0.44 | 0.35 |
| Composition C (comparative) | 0.58 | 0.42 |

Next 40 denier fibers are fed into the front delivery roll of a spinning frame at a draft of 5× and covered with a yarn of polyester fibers during a core spinning operation. The incidence of breaks and fiber derailings as the spool was unwound and fed into the machine is recorded over the first 3 hour period of operation. Average results (on an incidents per hour per 1000 spindle basis) are as indicated in Table IV.

TABLE IV

| | Breaks per 1000 spindles * hr | Derailing per 1000 spindles * hr |
|---|---|---|
| Composition A | <50 | <25 |
| Composition B (comparative) | >250 | >300 |

Next the core spun yarn is used to make a knitted fabric. The base weight of the fabrics so produced is measured by weighing a square piece of fabric of unit area. This fabric is then subjected to a 30 minutes boil-off at 100° C., followed by a spin drying, and 60 to 70° C. tumble drying until the fabric is dry. The base weight of the fabric conditioned at ambient conditions (Relative Humidity=65 percent, temperature=23° C.) for 4 hours is re-measured using the same technique as before. The results are as shown in Table V.

TABLE V

Fabric base weight change during boil-off at 100° C. for a polyester covered yarn

| | Fabric base weight | | |
|---|---|---|---|
| | Before boil-off ($g/m^2$) | After boil-off ($g/m^2$) | Base weight increase (percent) |
| Composition A | 182 | 262 | 44 percent |
| Composition B (comparative) | 138 | 206 | 28 percent |
| Composition C (comparative) | 205 | 268 | 31 percent |

What is claimed is:

1. A crosslinked elastic fiber characterized in that the fiber has been made from a composition comprising a polyolefin blend having an overall melt index ($I_2$) of less than 2.5 g/10 min before crosslinking with a density in the range of 0.865 to 0.885 $g/cm^3$ wherein the polyolefin blend comprises at least a first polyolefin component and a second polyolefin component, wherein the first component and second component can be classified according to the following characteristics: characteristic (a) is having a density in the range of from 0.855 to 0.88 $g/cm^3$; characteristic (b) is having a residual crystallinity at 80° C. of greater than 9%; and wherein the first component meets either characteristic (a) or characteristic (b) but not both, and the second component meets at least whichever characteristic (a) or (b) the first component does not meet.

2. The fiber of claim 1 wherein the second component is characterized as meeting both characteristic (a) and characteristic (b).

3. The fiber of claim 1 wherein the second component meets only one of characteristic (a) or characteristic (b).

4. The fiber of claim 1 wherein at least one polyolefin component meeting characteristic (a) comprises homogeneously branched polyethylene.

5. The fiber of claim 1 wherein at least one polyolefin component meeting characteristic (b) comprises a homogeneously branched polyethylene.

6. The fiber of claim 5 where the homogeneously branched polyethylene has a density greater than 0.89 $g/cm^3$.

7. The fiber of claim 6 wherein the homogeneously branched polyethylene component has a density greater than 0.91 $g/cm^3$.

8. The fiber of claim 1 wherein at least one polyolefin component meeting characteristic (b) comprises an olefinic segmented block copolymer.

9. The fiber of claim 1 wherein at least one polyolefin component meeting characteristic (a) comprises an olefinic segmented block copolymer.

10. The fiber of claim 1 wherein the overall blend has a melt index ($I_2$) less than 1.5.

11. The fiber of claim 1 wherein the overall blend has a density in the range of 0.868 and 0.875 $g/cm^3$.

12. The fiber of claim 1 wherein the overall blend has a residual crystallinity at 80° C. as measured by DSC on the second heat curve greater than 4%.

13. The fiber of claim 12 wherein the overall blend has a residual crystallinity greater than 7%.

14. The fiber of claim 1 wherein the overall blend has a molecular weight distributionless than about 2.5.

15. The fiber of claim 1 wherein characteristic (a) is having a density in the range of from 0.855 to 0.865 $g/cm^3$.

16. The fiber of claim 1 wherein the overall blend comprises from about 50 to about 95 percent by weight of material which meets characteristic (a).

17. The fiber of claim 1 wherein the overall blend comprises from about 5 to about 50 percent by weight of material which meets characteristic (b).

18. The fiber of claim 1 wherein the first polyolefin component and the second polyolefin component each have a molecular weight distribution less than 3.0.

19. The fiber of claim 1 where a component meeting characteristic (b) is a propylene based polyolefin.

20. The fiber of claim 1 further comprising from 0.1 to two percent by weight of the fiber of an organic or inorganic filler.

21. The fiber of claim 1 further comprising one or more additives selected from the group consisting of processing aids, slip agents, antiblocking agents, pigments, compatabilizers, co-agents for improving crosslinkability or combinations thereof.

* * * * *